US011305793B2

(12) United States Patent
Hata et al.

(10) Patent No.: US 11,305,793 B2
(45) Date of Patent: Apr. 19, 2022

(54) IMPACT TRANSMITTING STRUCTURE CONFIGURED TO TRANSMIT IMPACT TO IMPACT ABSORBING DEVICE OF RAILCAR

(71) Applicant: KAWASAKI JUKOGYO KABUSHIKI KAISHA, Kobe (JP)

(72) Inventors: Shinichiro Hata, Kobe (JP); Yuji Toya, Kobe (JP); Kazuyoshi Ikushima, Takarazuka (JP); Atsushi Sano, Kakogawa (JP); Tomonori Umebayashi, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 352 days.

(21) Appl. No.: 16/435,658

(22) Filed: Jun. 10, 2019

(65) Prior Publication Data

US 2019/0375437 A1 Dec. 12, 2019

(30) Foreign Application Priority Data

Jun. 8, 2018 (JP) ..... JP2018-109946

(51) Int. Cl.
*B61G 11/18* (2006.01)

(52) U.S. Cl.
CPC ..... *B61G 11/18* (2013.01)

(58) Field of Classification Search
CPC ..... B61G 11/00; B61G 11/02; B61G 11/04; B61G 11/06; B61G 11/08; B61G 11/10; B61G 11/12; B61G 11/14; B61G 11/16; B61G 11/18; B61G 3/00
See application file for complete search history.

(56) References Cited

U.S. PATENT DOCUMENTS

2008/0041268 A1 2/2008 Seitzberger et al.
2013/0299441 A1* 11/2013 Peckham ..... B61G 3/16 213/77

FOREIGN PATENT DOCUMENTS

EP 0532442 A1 * 3/1993 ..... B61G 11/16
EP 0827888 A1 * 3/1998 ..... B61D 15/06
EP 1927524 A1 * 6/2008 ..... B61G 11/16
WO WO-2015128850 A1 * 9/2015 ..... B61G 11/16

* cited by examiner

*Primary Examiner* — Robert J McCarry, Jr.
(74) *Attorney, Agent, or Firm* — Oliff PLC

(57) ABSTRACT

An impact transmitting structure includes: a first member provided at an end portion of a first car; and a second member provided at an end portion of a second car. One of the first member and the second member is a convex member. The other of the first member and the second member is a concave member. An opposing surface of the convex member which surface is located close to the concave member has a substantially V shape that is convex in a direction toward the concave member. An opposing surface of the concave member which surface is located close to the convex member has a substantially V shape that is concave in a direction away from the convex member. A tip end angle of the convex member is smaller than an opening angle of the concave member.

18 Claims, 3 Drawing Sheets

IMPACT TRANSMITTING STRUCTURE CONFIGURED TO TRANSMIT IMPACT TO IMPACT ABSORBING DEVICE OF RAILCAR

CROSS-REFERENCE TO RELATED APPLICATION

This application claims priority to and the benefit of Japanese Patent Application No. 2018-109946 filed on Jun. 8, 2018, the entire disclosure of which is incorporated herein by reference.

BACKGROUND

1. Technical Field

The present disclosure relates to an impact transmitting structure configured to transmit impact to an impact absorbing device of a railcar.

2. Description of the Related Art

In the field of railcars, in order to absorb collision energy generated when train sets collide with each other, impact absorbing devices are attached to respective tip end portions of head cars (end car) of the train sets in some cases. Further, in order to absorb collision energy generated when adjacent cars of a train set collide with each other, impact absorbing devices are attached to respective opposing end portions of the adjacent cars in some cases (for example, see U.S. Patent No. 2008/0041268). According to conventional impact absorbing devices, comb-shaped anti-climbers are provided at tip ends thereof. With this, when the impact absorbing devices collide with each other, displacement of relative positions of the impact absorbing devices in a vertical direction is prevented, and crush postures of the impact absorbing devices are stabilized.

However, when the heights of air springs of the cars that collide with each other are largely different from each other, large offset is generated between the impact absorbing devices that collide with each other. Further, when a train set travels through a route which causes large displacement at curve, a distance between adjacent cars increases. Therefore, when a front car collides to incline forward, and a rear car collides with the front car, large offset is generated in the vertical direction between the impact absorbing devices of the front and rear cars that collide with each other. As above, when an offset amount between the cars at the time of collision becomes large, the anti-climber itself inclines, so that load transfer along a neutral axis of the impact absorbing device is not performed. On this account, the impact absorbing device is not uniformly crushed, and therefore, the effect of absorbing the collision energy deteriorates. When the elasticity of the air spring in a car width direction is high, offset may also be generated in the car width direction. In this case, the impact absorbing device is not uniformly crushed as with the above.

SUMMARY

An object of the present disclosure is to provide a configuration in which even when an offset amount between cars at the time of collision is large, an impact absorbing device can satisfactorily absorb collision energy.

An impact transmitting structure configured to transmit impact to an impact absorbing device of a railcar according to one aspect of the present disclosure includes: a first member provided at an end portion of a first car which portion is located at a first side in a car longitudinal direction, the first member being arranged on a neutral axis of an impact absorbing device provided at the first car, the first member being configured to transmit collision energy to the impact absorbing device; and a second member provided at an end portion of a second car which portion is located at a second side in the car longitudinal direction and is possibly opposed to the first car, the second member being configured to contact the first member to generate the collision energy when the first car and the second car collide with each other. One of the first member and the second member is a convex member. The other of the first member and the second member is a concave member. An opposing surface of the convex member which surface is located close to the concave member has a substantially V shape that is convex in a direction toward the concave member when viewed from at least one of a car width direction and a vertical direction. An opposing surface of the concave member which surface is located close to the convex member has a substantially V shape that is concave in a direction away from the convex member when viewed from at least one of the car width direction and the vertical direction. A tip end angle of the convex member is smaller than an opening angle of the concave member.

An impact transmitting structure configured to transmit impact to an impact absorbing device of a railcar according to another aspect of the present disclosure includes: a first member provided at an end portion of a first car which portion is located at a first side in a car longitudinal direction, the first member being arranged on a neutral axis of an impact absorbing device provided at the first car, the first member being configured to transmit collision energy to the impact absorbing device; and a second member provided at an end portion of a second car which portion is located at a second side in the car longitudinal direction and is possibly opposed to the first car, the second member being configured to contact the first member to generate the collision energy when the first car and the second car collide with each other. One of the first member and the second member is a convex member. The other of the first member and the second member is a concave member. An opposing surface of the convex member which surface is located close to the concave member has a substantially V shape that is convex in a direction toward the concave member when viewed from at least one of a car width direction and a vertical direction. An opposing surface of the concave member which surface is located close to the convex member has a substantially V shape that is concave in a direction away from the convex member when viewed from at least one of the car width direction and the vertical direction. The opposing surface of the convex member and the opposing surface of the concave member are formed in such shapes that the opposing surfaces are brought into point-contact or line-contact with each other.

According to the above configurations, even when the first car and the second car which are largely offset from each other collide with each other, the convex member is smoothly guided by the concave member, and this corrects the offset. Thus, the load transfer along the neutral axis of the impact absorbing device is performed. Therefore, the impact absorbing device is uniformly crushed, and thus, the collision energy can be satisfactorily absorbed by the impact absorbing device.

The above object, other objects, features, and advantages of the present disclosure will be made clear by the following detailed explanation of preferred embodiments with reference to the attached drawings.

DESCRIPTION OF THE PREFERRED EMBODIMENTS

Hereinafter, an embodiment will be explained with reference to the drawings. In the following explanation, a direction in which a car travels is referred to as a car longitudinal direction (front-rear direction), and a lateral direction perpendicular to the car longitudinal direction is referred to as a car width direction (left-right direction).

Figure 1:
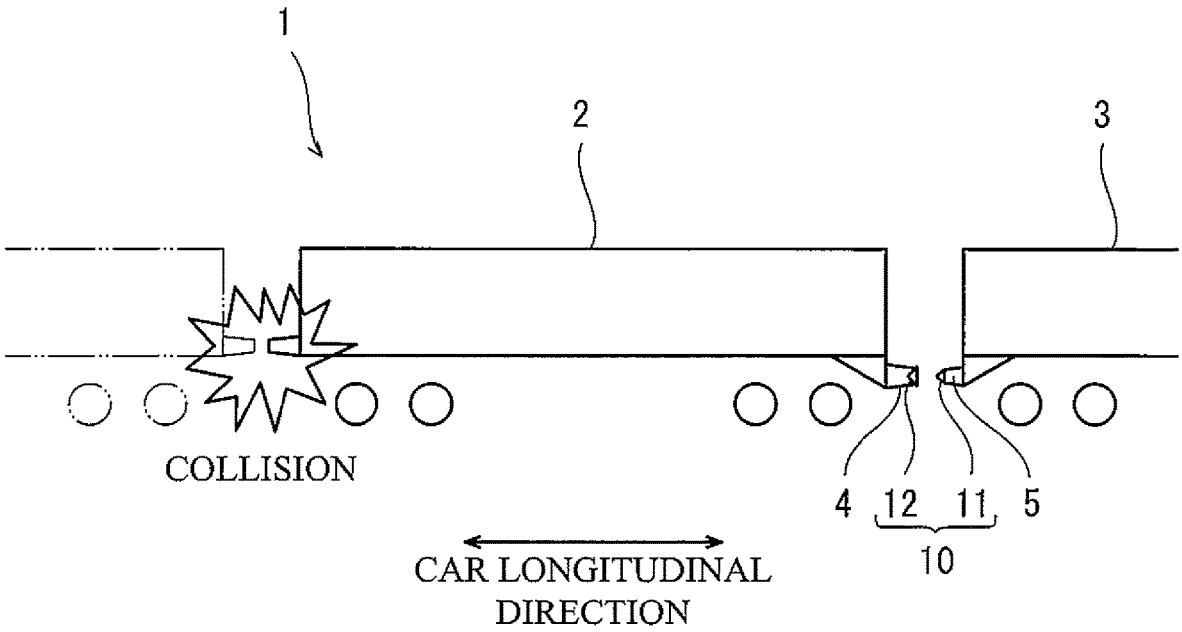
FIG. 1 is a side view of a railcar including an impact transmitting structure configured to transmit impact to an impact absorbing device according to an embodiment.

FIG. 1 is a side view of a railcar 1 including an impact transmitting structure configured to transmit impact to an impact absorbing device according to an embodiment. As shown in FIG. 1, the railcar 1 is a train set including a first car 2 and a second car 3 coupled to the first car 2. An impact absorbing device 4 is provided at an end portion of the first car 2 which portion is located close to the second car 3 in the car longitudinal direction. An impact absorbing device 5 is provided at end portion of the second car 3 which portion is located close to the first car 2 in the car longitudinal direction.

The impact absorbing device 4 projects from the end portion of the first car 2 toward the second car 3 and is arranged such that a neutral axis thereof is directed in the car longitudinal direction. The impact absorbing device 5 projects from the end portion of the second car 3 toward the first car 2 and is arranged such that a neutral axis thereof is directed in the car longitudinal direction. To be specific, the positions of the impact absorbing devices 4 and 5 are the same as each other in the car width direction and the vertical direction, and the impact absorbing devices 4 and 5 are opposed to each other in the car longitudinal direction.

An impact transmitting structure 10 is provided at a tip end of the impact absorbing device 4 of the first car 2 and a tip end of the impact absorbing device 5 of the second car 3. To be specific, the transmission of collision energy between the impact absorbing devices 4 and 5 is performed through the impact transmitting structure 10. The impact transmitting structure 10 includes a convex member 11 and a concave member 12. The convex member 11 is provided at the tip end of the impact absorbing device 5 of the second car 3, and the concave member 12 is provided at the tip end of the impact absorbing device 4 of the first car 2.

For example, when the railcar 1 collides with another railcar, the first car 2 of the railcar 1 inclines forward, and therefore, the end portion of the first car 2 which portion is located close to the second car 3 moves upward. Thus, large offset is possibly generated between the impact absorbing devices 4 and 5 in the vertical direction. According to the below-described impact transmitting structure 10, after the offset is corrected, the transmission of the collision energy between the impact absorbing devices 4 and 5 is performed.

Figure 2:
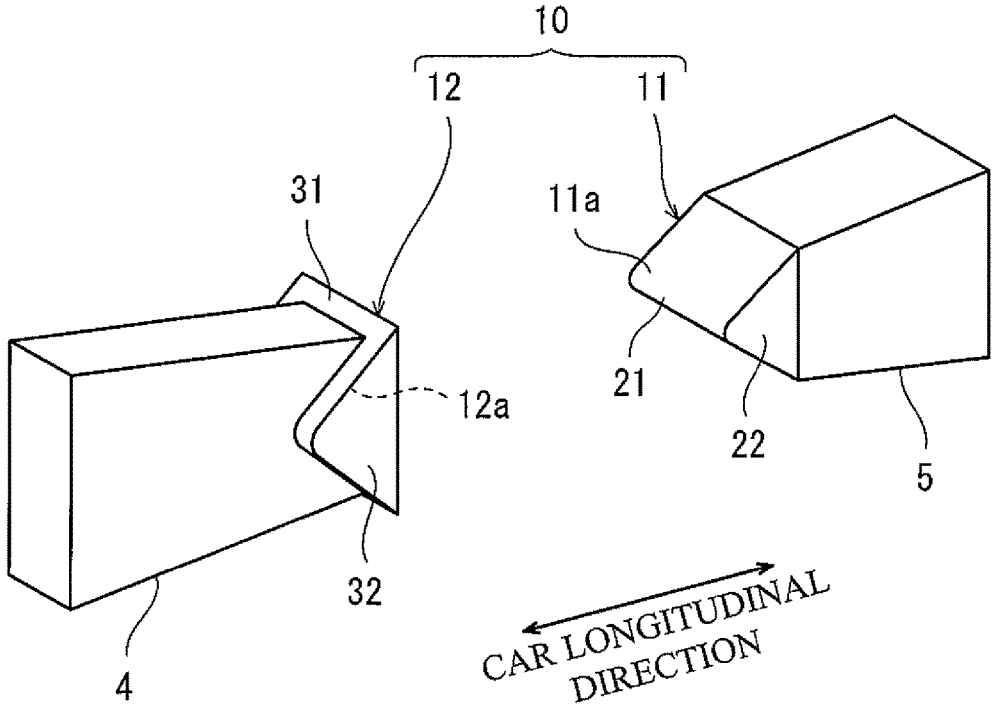
FIG. 2 is a perspective view of the impact absorbing device and impact transmitting structure shown in FIG. 1.
Figure 3:
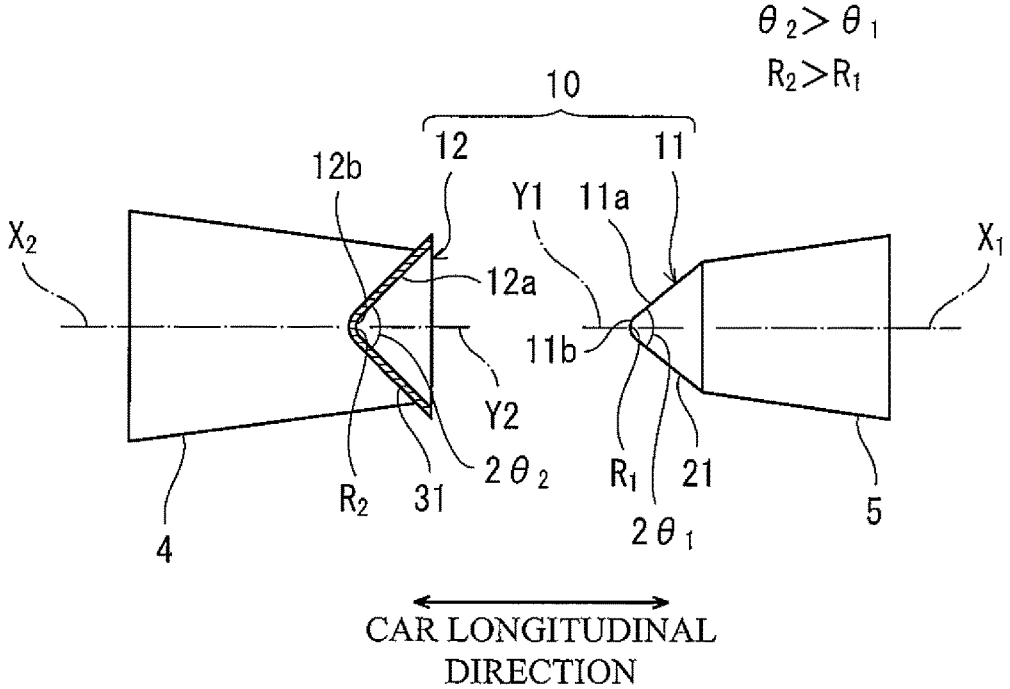
FIG. 3 is a side sectional view of the impact absorbing device and impact transmitting structure shown in FIG. 2.

FIG. 2 is a perspective view of the impact absorbing devices 4 and 5 and impact transmitting structure 10 shown in FIG. 1. FIG. 3 is a side sectional view of the impact absorbing devices 4 and 5 and impact transmitting structure 10 shown in FIG. 2. As shown in FIGS. 2 and 3, the convex member 11 of the impact transmitting structure 10 is arranged on a neutral axis $X_1$ of the impact absorbing device 5, and the concave member 12 of the impact transmitting structure 10 is arranged on a neutral axis $X_2$ of the impact absorbing device 4. Specifically, a central axis $Y_1$ of the convex member 11 in an upper-lower direction is located on the neutral axis $X_1$ of the impact absorbing device 5, and a central axis $Y_2$ of the concave member 12 in the upper-lower direction is located on the neutral axis $X_2$ of the impact absorbing device 4. In the present embodiment, the convex member 11 has a symmetrical shape in the vertical direction and the car width direction, and the concave member 12 has a symmetrical shape in the vertical direction and the car width direction. Therefore, a tip end 11*b* of the convex member 11 is arranged on the neutral axis $X_1$ of the impact absorbing device 5, and a bottom end 12*b* of the concave member 12 is arranged on the neutral axis $X_2$ of the impact absorbing device 4. The convex member 11 may be provided at the impact absorbing device 4, and the concave member 12 may be provided at the impact absorbing device 5, i.e., the positions of the convex member 11 and the concave member 12 may be reversed.

An opposing surface 11*a* of the convex member 11 is located at a first side in the car longitudinal direction and has a substantially V shape, i.e., is convex toward the first side in the car longitudinal direction when viewed from the car width direction. Specifically, the convex member 11 includes an opposing wall portion 21 and closing wall portions 22. The opposing surface 11*a* opposed to the concave member 12 is provided at the opposing wall portion 21, and the opposing wall portion 21 has a substantially V-shaped section when viewed from the car width direction. The closing wall portions 22 are connected to respective end portions of the opposing wall portion 21 so as to close, from the car width direction, a space formed between the opposing wall portion 21 and the impact absorbing device 5. It should be noted that the convex member 11 may be a solid member which does not form the space between the opposing wall portion 21 and the impact absorbing device 5.

An opposing surface 12*a* of the concave member 12 is located at a second side in the car longitudinal direction and has a substantially V shape, i.e., is concave toward the first side in the car longitudinal direction when viewed from the car width direction. Specifically, the concave member 12 includes an opposing wall portion 31 and closing wall portions 32. The opposing surface 12*a* is provided at the opposing wall portion 31, and the opposing wall portion 31 has a substantially V-shaped section when viewed from the car width direction. The closing wall portions 32 are connected to respective end portions of the opposing wall portion 31 so as to close, from the car width direction, a concave space formed by the opposing surface 12*a*. According to this configuration, the concave member 12 is formed in a bucket shape and increases in strength. Therefore, the deformation of the opposing wall portion 31 at the time of collision is suppressed.

A tip end angle ($=2\theta_1$) of the convex member 11 is set to be smaller than an opening angle ($=2\theta_2$) of the concave member 12. The tip end 11*b* of the convex member 11 has a round shape, and the bottom end 12*b* of the concave member 12 has a round shape. To be specific, the tip end 11*b* of the convex member 11 has a circular-arc shape that projects toward the concave member 12 when viewed from the car width direction, and the bottom end 12*b* of the concave member 12 has a circular-arc shape that is depressed toward an opposite side of the convex member 11 when viewed from the car width direction. A curvature radius $R_2$ of the round shape of the bottom end 12*b* of the concave member 12 is larger than a curvature radius $R_1$ of the round shape of the tip end of the convex member 11.

Figure 4:
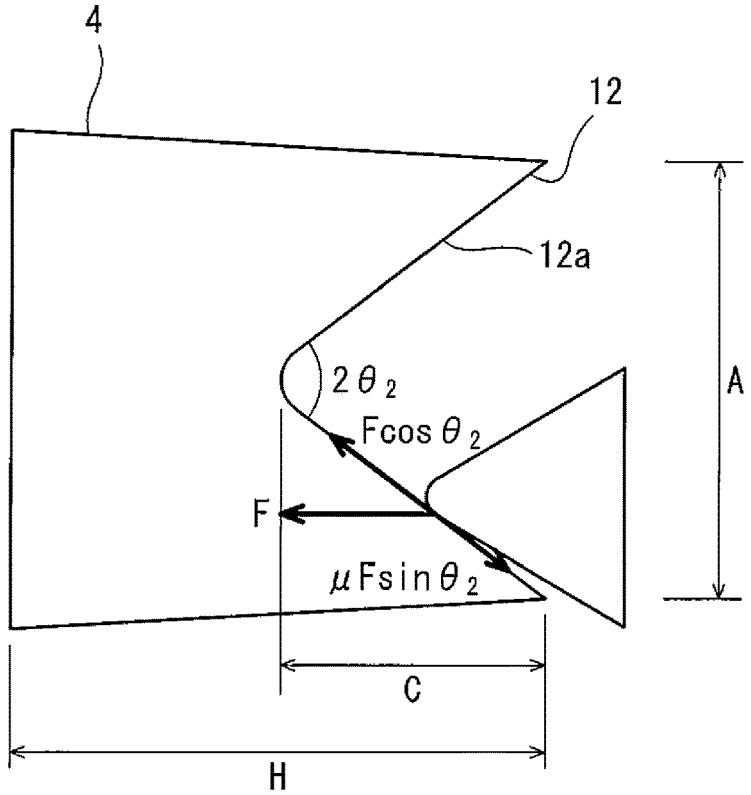
FIG. 4 is a schematic diagram for explaining a geometric shape of the impact transmitting structure shown in FIG. 3.

FIG. 4 is a schematic diagram geometrically showing the impact transmitting structure 10 shown in FIG. 3. In FIG. 4, "H" denotes length in the car longitudinal direction from a base end of the impact absorbing device 4, to which the concave member 12 is attached, to the tip end of the concave member 12, "A" denotes tip end open width of the concave member 12, "C" denotes concave depth of the concave member 12, and μ denotes a friction coefficient of the opposing surface 12*a* of the concave member 12.

First, in order to make the convex member 11 smoothly slide on the opposing surface 12*a* of the concave member 12, sliding force ($F \cos \theta_2$) needs to be larger than frictional force ($\mu F \sin \theta_2$). Therefore, Formula 1 is established.

$$\mu F \sin \theta_2 < F \cos \theta_2 \quad \text{Formula 1}$$

Then, Formula 2 is derived from Formula 1.

$$\tan \theta_2 < \frac{1}{\mu} \quad \text{Formula 2}$$

When the opening angle $2\theta_2$ of the concave member 12 is set so as to satisfy Formula 2, the opposing surface 12*a* of the concave member 12 smoothly guides the convex member 11.

Next, since the concave member 12 achieves a guiding function with respect to the impact absorbing device 4, Formula 3 is established.

$$C \leq H \quad \text{Formula 3}$$

Since the concave depth C is geometrically shown by Formula 4, Formula 5 is derived from Formula 3 and Formula 4.

$$C \leqq \frac{A}{2} \cdot \frac{1}{\tan \theta_2} \quad \text{Formula 4}$$

$$\frac{A}{2\tan \theta_2} \leqq H \quad \text{Formula 5}$$

Then, Formula 6 is derived from Formula 5.

$$\tan \theta_2 \geqq \frac{A}{2H} \quad \text{Formula 6}$$

To be specific, the opening angle $2\theta_2$ of the concave member 12 is set so as to satisfy Formula 2 and Formula 6.

Figure 5:
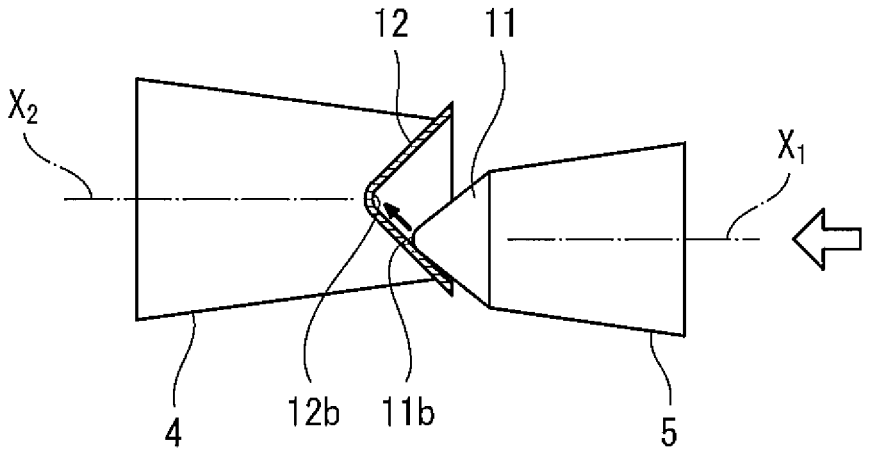
FIG. 5 is a side sectional view for explaining operations of the impact transmitting structure of FIG. 3 at the time of offset collision.

FIG. 5 is a side sectional view for explaining operations of the impact transmitting structure 10 of FIG. 3 at the time of offset collision. As shown in FIG. 5, when the convex member 11 and the concave member 12 collide with each other with the impact absorbing devices 4 and 5 offset from each other in the vertical direction, the convex member 11 starts being guided along the concave member 12 by the round shape of the tip end 11*b* of the convex member 11. Further, as described above, the tip end angle $2\theta_1$ of the convex member 11 is smaller than the opening angle $2\theta_2$ of the concave member 12. Therefore, when the convex member 11 starts colliding with the concave member 12, the opposing surface 11*a* of the convex member 11 and the opposing surface 12*a* of the concave member 12 are brought into point-contact or line-contact with each other, and the convex member 11 is guided while sliding on the opposing surface 12*a* of the concave member 12.

Then, as described above, the curvature radius $R_2$ of the bottom end 12*b* of the concave member 12 is larger than the curvature radius $R_1$ of the round shape of the tip end of the convex member 11. Therefore, finally, the tip end 11*b* of the convex member 11 contacts the bottom end 12*b* of the concave member 12. On this account, the collision energy is generated at the tip end 11*b* of the convex member 11 and the bottom end 12*b* of the concave member 12, and the load transfer along the neutral axes $X_1$ and $X_2$ of the impact absorbing devices 4 and 5 is performed. Thus, the impact absorbing devices 4 and 5 are uniformly crushed.

According to the above explained configuration, even when the first car 2 and the second car 3 which are largely offset from each other collide with each other, the convex member 11 is smoothly guided by the concave member 12, and this corrects the offset. Thus, the load transfer along the neutral axes $X_1$ and $X_2$ of the impact absorbing devices 4 and 5 is performed. Therefore, the impact absorbing devices 4 and 5 are uniformly crushed, and thus, the collision energy can be satisfactorily absorbed by the impact absorbing devices 4 and 5.

Figure 6:
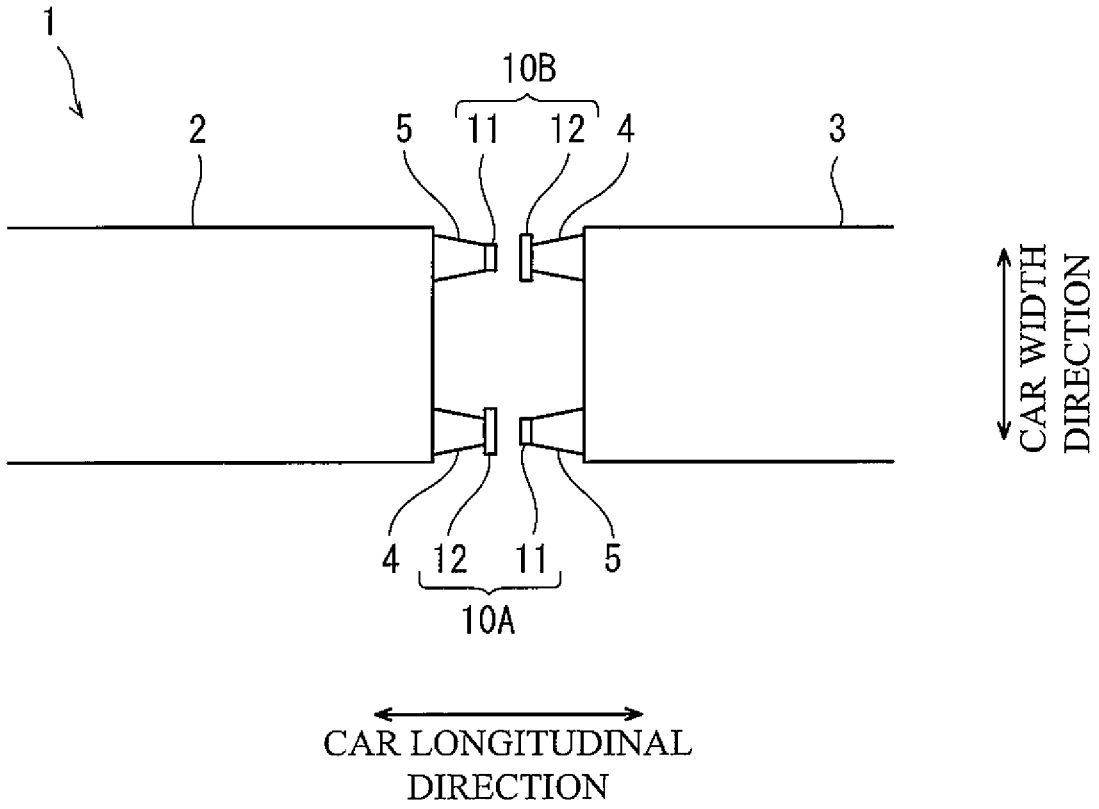
FIG. 6 is a plan view for schematically explaining an arrangement example of the impact transmitting structure of FIG. 2 at a railcar.

FIG. 6 is a plan view for schematically explaining an arrangement example of impact transmitting structures 10A and 10B of FIG. 2 at the railcar 1. As shown in FIG. 6, the concave member 12 of the impact transmitting structure 10A is provided at an end portion of the first car 2 which portion is located at a first side in the car width direction, and the convex member 11 of the impact transmitting structure 10B is provided at an end portion of the first car 2 which portion is located at a second side in the car width direction. The convex member 11 of the impact transmitting structure 10A is provided at an end portion of the second car 3 which portion is located at the first side in the car width direction, and the concave member 12 of the impact transmitting structure 10B is provided at an end portion of the second car 3 which portion is located at the second side in the car width direction.

To be specific, when a pair of left and right impact transmitting structures 10 are provided, the relation of the projection and the depression is reversed between the left impact transmitting structure 10A and the right impact transmitting structure 10B. According to this arrangement, even when the first car 2 and the second car 3 are uncoupled from each other, and the directions of the first and second cars 2 and 3 are changed, the concave member 12 is not opposed to the concave member 12 but opposed to the convex member 11. Therefore, the order of the cars of the train set can be changed without replacing the convex member 11 and the concave member 12.

The present disclosure is not limited to the above embodiment, and modifications, additions, and eliminations may be made with respect to the configuration of the present disclosure. For example, in the above embodiment, each of the opposing surface 11*a* of the convex member 11 and the opposing surface 12*a* of the concave member 12 has a substantially V shape that is symmetrical in the upper-lower direction. However, each of the opposing surface 11*a* of the convex member 11 and the opposing surface 12*a* of the concave member 12 may have a substantially V shape that is asymmetrical in the upper-lower direction, i.e., for example, a substantially V shape that is open large in one of the upper and lower directions and open small in the other of the upper and lower directions. For example, in a case where the central axes of the convex member 11 and the concave member 12 do not coincide with the neutral axes of the impact absorbing devices 4 and 5 due to some restriction when each of the shapes of the convex member 11 and the concave member 12 is symmetrical, or in a case where each of the shapes of the impact absorbing devices 4 and 5 is required to be asymmetrical, each of the opposing surface 11*a* of the convex member 11 and the opposing surface 12*a* of the concave member 12 may be made asymmetrical such that a load action line and the neutral axes coincide with each other, and the impact transmitting structure may be configured such that moment is not generated in the load transfer from the convex member 11 and the concave member 12 to the impact absorbing devices 4 and 5.

In the above embodiment, each of the opposing surface 11*a* of the convex member 11 and the opposing surface 12*a* of the concave member 12 has a substantially V shape when viewed from the car width direction such that the offset in the vertical direction can be corrected. However, each of the opposing surface 11*a* of the convex member 11 and the opposing surface 12*a* of the concave member 12 may have a substantially V shape when viewed from the vertical direction such that the offset in the car width direction can be corrected. Further, each of the opposing surface 11*a* of the convex member 11 and the opposing surface 12*a* of the concave member 12 may have a substantially conical shape such that both the offset in the vertical direction and the offset in the car width direction can be corrected.

The impact absorbing devices 4 and 5 do not have to project outward in the car longitudinal direction from the car and may be incorporated in the underframe. The impact absorbing devices 4 and 5 may be provided at an end car (a head car or a last car) of a train set. One of the convex member 11 and the concave member 12 may be provided at a carbody instead of the impact absorbing device. Each of the opposing surface 11*a* of the convex member 11 and the opposing surface 12*a* of the concave member 12 may have a shape different from the above shapes as long as the opposing surfaces 11*a* and 12*a* are brought into point-contact or line-contact with each other. The opposing surface 11*a* of the convex member 11 and/or the bottom end 12*b* of the concave member 12 may have pointed shapes instead of the round shapes.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

What is claimed is:

1. An impact transmitting structure configured to transmit impact to an impact absorbing device of a railcar, the impact transmitting structure comprising:

a first member at an end portion of a first car which is at a first side in a car longitudinal direction, the first member being on a neutral axis of an impact absorbing device at the first car, the first member being configured to transmit collision energy to the impact absorbing device; and a second member at an end portion of a second car which is at a second side in the car longitudinal direction and is opposed to the first car, the second member being configured to contact the first member to generate the collision energy when the first car and the second car collide with each other, wherein:

one of the first member and the second member is a convex member;

the other of the first member and the second member is a concave member;

an opposing surface of the convex member which is close to the concave member is a continuous surface and has a substantially V shape that is convex in a direction toward the concave member when viewed from at least one of a car width direction and a vertical direction;

an opposing surface of the concave member which is close to the convex member has a substantially V shape that is concave in a direction away from the convex member when viewed from at least one of the car width direction and the vertical direction; and a tip end angle of the convex member is smaller than an opening angle of the concave member.

2. The impact transmitting structure according to claim 1, wherein a tip end of the convex member has a round shape.

3. The impact transmitting structure according to claim 1, wherein a central axis of the first member in an upper-lower direction is on the neutral axis of the impact absorbing device.

4. The impact transmitting structure according to claim 1, wherein the concave member includes:

an opposing wall portion including the opposing surface and having a substantially V-shaped section when viewed from the car width direction; and a closing wall portion connected to an end portion of the opposing wall portion so as to close, from the car width direction, a concave space formed by the opposing surface.

5. The impact transmitting structure according to claim 1, wherein the opposing surface of the convex member and the opposing surface of the concave member are formed in shapes such that the opposing surfaces are brought into point-contact or line-contact with each other.

6. The impact transmitting structure according to claim 5, wherein a tip end of the convex member has a round shape.

7. The impact transmitting structure according to claim 6, wherein:

a bottom end of the concave member has a round shape; and a curvature radius of the round shape of the tip end of the convex member is smaller than a curvature radius of the round shape of the bottom end of the concave member.

8. The impact transmitting structure according to claim 5, wherein:

another impact absorbing device is at the second car;

the second member is on a neutral axis of the other impact absorbing device at the second car and is configured to transmit the collision energy to the other impact absorbing device;

the concave member is attached to the impact absorbing device of the first car or the another impact absorbing device of the second car; and an opening angle $2\theta_2$ of the concave member satisfies $A/2H \leq \tan \theta_2 < 1/\mu$, where H denotes length in the car longitudinal direction from a base end of the impact absorbing device, to which the concave member is attached, to a tip end of the concave member, A denotes tip end open width of the concave member, and $\mu$ denotes a friction coefficient of the opposing surface of the concave member.

9. An impact transmitting structure configured to transmit impact to an impact absorbing device of a railcar, the impact transmitting structure comprising:

a first member at an end portion of a first car which is at a first side in a car longitudinal direction, the first member being on a neutral axis of an impact absorbing device at the first car, the first member being configured to transmit collision energy to the impact absorbing device; and a second member at an end portion of a second car which is at a second side in the car longitudinal direction and is opposed to the first car, the second member being configured to contact the first member to generate the collision energy when the first car and the second car collide with each other, wherein:

one of the first member and the second member is a convex member;

the other of the first member and the second member is a concave member;

an opposing surface of the convex member which is close to the concave member has a substantially V shape that is convex in a direction toward the concave member when viewed from at least one of a car width direction and a vertical direction;

an opposing surface of the concave member which is close to the convex member has a substantially V shape that is concave in a direction away from the convex member when viewed from at least one of the car width direction and the vertical direction; and a tip end angle of the convex member is smaller than an opening angle of the concave member;

a tip end of the convex member has a round shape;

a bottom end of the concave member has a round shape; and a curvature radius of the round shape of the tip end of the convex member is smaller than a curvature radius of the round shape of the bottom end of the concave member.

10. The impact transmitting structure according to claim 9, wherein a tip end of the convex member has a round shape.

11. The impact transmitting structure according to claim 9, wherein:

another impact absorbing device is at the second car;

the second member is arranged on a neutral axis of the other impact absorbing device at the second car and is configured to transmit the collision energy to the other impact absorbing device;

the concave member is attached to the impact absorbing device of the first car or the other impact absorbing device of the second car; and an opening angle $2\theta_2$ of the concave member satisfies $A/2H \tan \theta_2 < 1/\mu$, where H denotes length in the car longitudinal direction from a base end of the impact absorbing device, to which the concave member is attached, to a tip end of the concave member, A denotes tip end open width of the concave member, and $\mu$ denotes a friction coefficient of the opposing surface of the concave member.

12. The impact transmitting structure according to claim 9, wherein a central axis of the first member in an upper-lower direction is on the neutral axis of the impact absorbing device.

13. The impact transmitting structure according to claim 9, wherein the concave member includes:

an opposing wall portion including the opposing surface and having a substantially V-shaped section when viewed from the car width direction; and a closing wall portion connected to an end portion of the opposing wall portion so as to close, from the car width direction, a concave space formed by the opposing surface.

14. An impact transmitting structure configured to transmit impact to an impact absorbing device of a railcar, the impact transmitting structure comprising:

a first member at an end portion of a first car which is at a first side in a car longitudinal direction, the first member being on a neutral axis of an impact absorbing device at the first car, the first member being configured to transmit collision energy to the impact absorbing device; and a second member at an end portion of a second car which is at a second side in the car longitudinal direction and is opposed to the first car, the second member being configured to contact the first member to generate the collision energy when the first car and the second car collide with each other, wherein:

one of the first member and the second member is a convex member;

the other of the first member and the second member is a concave member;

an opposing surface of the convex member which is close to the concave member has a substantially V shape that is convex in a direction toward the concave member when viewed from at least one of a car width direction and a vertical direction;

an opposing surface of the concave member which is close to the convex member has a substantially V shape that is concave in a direction away from the convex member when viewed from at least one of the car width direction and the vertical direction; and a tip end angle of the convex member is smaller than an opening angle of the concave member;

another impact absorbing device is at the second car;

the second member is on a neutral axis of the other impact absorbing device at the second car and is configured to transmit the collision energy to the other impact absorbing device;

the concave member is attached to the impact absorbing device of the first car or the other impact absorbing device of the second car; and an opening angle $2\theta_2$ of the concave member satisfies $A/2H \leq \tan \theta_2 < 1/\mu$, where H denotes length in the car longitudinal direction from a base end of the impact absorbing device, to which the concave member is attached, to a tip end of the concave member, A denotes tip end open width of the concave member, and $\mu$ denotes a friction coefficient of the opposing surface of the concave member.

15. The impact transmitting structure according to claim 14, wherein a tip end of the convex member has a round shape.

16. The impact transmitting structure according to claim 14, wherein a central axis of the first member in an upper-lower direction is on the neutral axis of the impact absorbing device.

17. The impact transmitting structure according to claim 14, wherein the concave member includes:

an opposing wall portion including the opposing surface and having a substantially V-shaped section when viewed from the car width direction; and a closing wall portion connected to an end portion of the opposing wall portion so as to close, from the car width direction, a concave space formed by the opposing surface.

18. A railcar comprising:

a first car and a second car coupled to each other;

a pair of impact absorbing devices at an end portion of the first car and spaced apart from each other in a car width direction, the end portion being located close to the second car; and a pair of impact transmitting structures that correspond to the pair of impact absorbing devices, wherein:

each of the impact transmitting structures includes a first member at the end portion of the first car and on a neutral axis of the impact absorbing device at the first car, the first member being configured to transmit collision energy to the impact absorbing device, and a second member at an end portion of the second car which is close to the first car, the second member being configured to contact the first member to generate the collision energy when the first car and the second car collide with each other;

one of the first member and the second member is a convex member;

the other of the first member and the second member is a concave member;

an opposing surface of the convex member which surface is located close to the concave member has a substantially V shape that is convex in a direction toward the concave member when viewed from at least one of the car width direction and a vertical direction;

an opposing surface of the concave member which is close to the convex member is a continuous surface and has a substantially V shape that is concave in a direction away from the convex member when viewed from at least one of the car width direction and the vertical direction;

the opposing surface of the convex member and the opposing surface of the concave member are formed in shapes such that the opposing surfaces are brought into point-contact or line-contact with each other;

the concave member of the impact transmitting structure is at a first side of the end portion of the first car in the car width direction;

the convex member of the impact transmitting structure is at a second side of the end portion of the first car in the car width direction;

the convex member of the impact transmitting structure is at a first side of the end portion of the second car in the car width direction; and the concave member of the impact transmitting structure is at a second side of the end portion of the second car in the car width direction.

* * * * *